US005323170A

United States Patent [19]

Lang

[11] Patent Number: 5,323,170

[45] Date of Patent: Jun. 21, 1994

[54] RADOMES HAVING VINYL FOAM CORE CONSTRUCTION

[75] Inventor: Richard L. Lang, Grand Prairie, Tex.

[73] Assignee: M & N Aerospace, Inc., Springtown, Tex.

[21] Appl. No.: 960,084

[22] Filed: Oct. 9, 1992

[51] Int. Cl.[5] ..... H01Q 1/42

[52] U.S. Cl. ..... 343/872; 343/705

[58] Field of Search ..... 343/872, 909, 705, 708; 428/34.6, 34.7, 141; H01Q 1/42

[56] References Cited

U.S. PATENT DOCUMENTS

| | | | |
|---|---|---|---|
| 2,614,059 | 10/1952 | Cooper | 343/872 |
| 3,063,654 | 11/1962 | Youngren et al. | 343/872 |
| 3,292,544 | 12/1966 | Caldwell et al. | 343/872 |
| 4,896,164 | 1/1990 | Burke et al. | 343/872 |

*Primary Examiner*—Donald Hajec
*Assistant Examiner*—Hoanganh Le
*Attorney, Agent, or Firm*—Head & Johnson

[57] ABSTRACT

A radome constructed using a rigid or semi-rigid foam core and sandwich construction is described. The foam core radome virtually eliminates water absorption problems associated with present technology radomes. The radome also provides greater impact strength and consistent, high radar transparency without sacrificing weight and structural stability, thereby providing a much longer service life in moisture/impact critical environments. Preferably, the radome includes a vinyl rigid closed-cell foam core consisting of a polymeric alloy of a cross-linked aromatic polyamide urea and a linear vinyl polymer.

12 Claims, 4 Drawing Sheets

RADOMES HAVING VINYL FOAM CORE CONSTRUCTION

TECHNICAL FIELD

The present invention relates generally to aircraft nose radomes and, more particularly, to a radome having a vinyl rigid or semi-rigid foam core.

BACKGROUND OF THE INVENTION

The word "radome" dates back to World War II and comes from the two words 'radar' and 'dome'. Originally, radome referred to radar transparent, dome-shaped structures used to protect radar antennas on aircraft. Over time, however, radome has come to mean almost any structure that protects and serves as a "window" for electromagnetic radiation up to 1,000 GHz. Such structures may be ground based and may be flat rather than dome shaped. Commercial aircraft carriers typically utilize a nose radome. Accordingly, for purposes of brevity, the term radome will hereinafter be understood to refer to a nose radome installed on aircraft to protect weather radar.

The need for all-weather operation of both military and commercial aircraft demands that an effective weather tracking radar be operational at all times. A device is needed to cover the antenna that is strong enough to protect it, yet transparent to radar.

A radome is an integral part of a radar system because thickness and other properties affect the effectiveness of the radar set. This requires that a radome be compatible to the specific properties of the radar set used therein. Major design criteria of a radome include: radar transparency, structural integrity, aerodynamic shape, and light weight. Economics also require that the cost should be as low as possible and the service life as long as possible. Successful radome design must balance all of the conflicting requirements. For example, the ideal shape of a nose radome from an electrical standpoint is hemispherical and as large as the aircraft will allow. A better aerodynamic shape, however, is conical. A thick wall would have structural benefits, yet for optimum radar transmission, the wall must be a factor of the wavelength. A lightweight design may improve aircraft performance, save fuel, and occasionally reduce product cost at the expense of decreased service life, increased maintenance costs, and/or increased product costs.

It is well known in the art that radomes fail when subjected to severe structural damage or radar degradation. There are numerous ways for this to occur in the hostile environment in which radomes must operate. High velocity rain is widely recognized as a leading cause of radome failure. Impact and erosion due to rain initiate damage and pinholes. Additionally, rain causes further damage as it seeks pinholes (i.e. moisture paths) and penetrates into the core.

Moreover, high velocity rain impacts and erodes paint systems and radome skins, particularly in the forward area of the radome. This opens moisture paths and reduces structural integrity. Solutions to the rain erosion problem include maintaining a rain erosion resistant painting system on the radome. Polyurethane and rubber boots are also available to install on the tip of radomes. If adequate erosion protection is used, the dominant mode of failure due to high velocity rain appears to be core impact failure or "soft spots." This promotes microcracking and moisture propagation.

It is also well known in the art that moisture, in the form of water and/or ice, can enter an open-cell core through any microcrack or pinhole in the skin. Altitude changes lead to freeze-thaw cycles, which causes water to expand by about 10% when it freezes. Repetitive freezing and thawing results in delaminations, cracking and the like in the core. Water and ice are also detrimental to radar transmissivity as their dielectric constant is on the order of 20 times greater than that of most materials used for sandwich construction nose radomes.

Additionally, multiple impact strikes are sustained during rain and hail storms. Bird and equipment strikes can inflict major single impacts. Smaller impacts can damage the radome's outer surface, causing delaminations, microcracks and opening up moisture paths. A large enough bird or equipment strike could go completely through the radome and severely damage the antenna.

Moreover, lightning strikes also pose serious problems to radomes. Depending on the current in the strike, lightning can penetrate the radome and damage the antenna, delaminate large sections or leave a microscopic pinhole. Even small holes and delaminated areas open moisture paths. Therefore, many radomes are equipped with lightning protection. This usually consists of strips of conductive material that are grounded to the fuselage. The strips must be placed so that the radar transparency of the radome is not adversely affected. While this does not alleviate the problem entirely, lightning diverter strips do reduce the risk of damage by conducting lightning to the fuselage and away from the antenna and radome.

Finally, static electricity on the outer surface of a radome can burn through the wall when the charge moves towards the antenna or another electrically conductive surface. Static burns are small, about the size of a pinhole, and the surrounding area may be blackened. Even so, any puncture allows moisture into the structure. This can be avoided by using anti-static paint or primer, which permits static electricity to bleed off to the airplane before a charge large enough to create a hole can build up.

Currently, the most common radomes among subsonic and transonic aircraft are fiberglass reinforced honeycomb core sandwich construction radomes. Standard hexagonal cell shaped honeycomb is generally not flexible enough for tight radii. Therefore, in many radomes, a higher density honeycomb variation called "flex core" is used in the nose section.

Honeycomb core radomes have excellent static strength/stiffness-to-weight ratios, excellent radar transparency, and are relatively easy to process. However, honeycomb core has an open-cell structure which encourages moisture intrusion, and it has relatively poor impact properties. Some honeycomb core radomes include a layer of polyvinyl fluoride (TEDLAR ®) on the inside skin to aid in sealing out moisture.

Static properties, FEM analysis and testing traditionally have led aircraft designers to select honeycomb core to construct the "best" radome. Although "best" is often defined as lightest, stiffest and strongest, this approach is often inadequate, especially in impact/moisture critical environments, such as radome and marine applications. The FAA repair station has collected radome repair data for about 20 years. About 85% of all honeycomb radomes are removed for moisture, and most air carriers confirm that their mean-time-between failures is substantially less than two years for "737" style honeycomb radomes. Consequently, high maintenance costs, high inventory and questionable radar performance (due to moisture) occur.

As noted above, some of the numerous ways for moisture paths to be created are impacts from hail, rain, bird, equipment strikes, static electricity pinholes and stress microcracks, which may be invisible. During flight, however, dynamic wind pressure pumps water through the microcracks into the core.

Once moisture gets through the skin, it collects in the honeycomb cells of prior art radomes. As the water freezes, it expands and cracks the cell walls leaving a path for moisture contamination to propagate. Over time, a large portion of the radome may be damaged from just one crack. Even if structural damage is not evident, moisture contamination must be repaired because the presence of water and ice severely diminish radar performance.

Another common type of radome used in aircrafts are the fluted core radomes, which are manufactured for McDonnell Douglas radomes. Fluted core is a series of square fiberglass tubes and was adopted to combat the moisture contamination problem associated with the honeycomb core radomes. Ideally, any moisture introduced into the radome flows through the flutes away from the electrically critical window. The moisture resistance of this type of core is somewhat better than that of honeycomb, thereby providing longer service life and fewer repairs.

However, fluted core has a high density (approximately 200 kg/m$^3$), which is over twice as dense as other radome core materials. In addition, the construction of a fluted core radome is very labor intensive, which leads to an expensive finished product. Furthermore, repairs are expensive and time consuming. A fluted core radome also weighs approximately 30% more than its honeycomb counterpart. The weight and expense trade-offs are not acceptable to many radome designers, especially since fluted core radomes eventually retain moisture.

Yet another type of radome known in the art is the foam core radome. Foam-in-place radomes (polyurethane foam) were popular in the 1950's, but its tendency to crumble, poor fatigue and poor impact properties quickly gave "foam radomes" an unfavorable name. Other foams that are touted as closed-cell (i.e. polymethacrylimide foam) actually have poor moisture absorption properties. This history of poor "foam radome" performance has hindered the development of other radomes using a better suited foam.

There has therefore been a long-felt need to provide a radome construction that solves the longstanding problems of the prior art.

BRIEF SUMMARY OF THE INVENTION

It is an object of the present invention to provide a radome having a vinyl rigid or semi-rigid foam core.

Another object of the present invention is to provide a foam core which is a closed-cell foam having significantly improved moisture resistance.

It is yet another object of the invention to provide a foam core radome having improved impact strength characteristics and resistance.

Still a further object of the invention is to provide a radome using a foam core which has improved radar transparency.

Preferably, the foam core is constructed of a rigid, closed-cell foam consisting of a polymeric alloy of a cross-linked aromatic polyamide urea and a linear vinyl polymer. This product is marketed under the trademark Divinycell TM.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION

It has now been ascertained that radomes constructed using a certain foam core material provide unexpected and distinct advantages over radome cores traditionally employed in the prior art. The core is formed of a rigid material in which the foam is formed at an elevated temperature. Alternatively, the core is formed of a semi-rigid material in which the foam is formed at room or ambient temperature. The temperature of formation is dependent on factors such as the actual foam utilized and the density of such foam. For example, a foam having a higher density will usually require a higher temperature of formation. In the preferred embodiment of the invention, the core is a rigid, closed-cell foam consisting of a polymeric alloy of a cross-linked aromatic polymide-urea and a linear vinyl polymer. This product is commercially available and sold under the trademark Divinycell TM.

Figure 1:
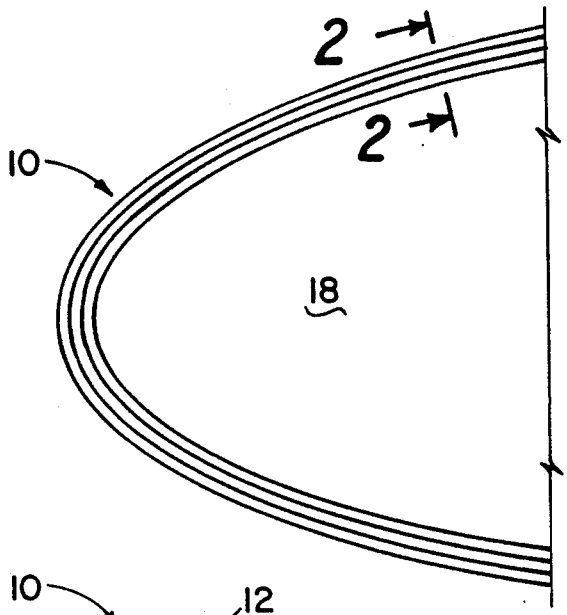
FIG. 1 illustrates a radome constructed in accordance with the present invention.
Figure 2:
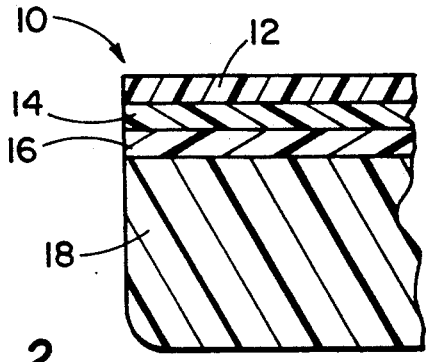
FIG. 2 is a cross-sectional view taken along 2—2' of FIG. 1.

As illustrated in FIGS. 1 and 2, the present invention includes radome 10. Radome 10 preferably comprises an outer skin 12, a foam core 14 and an inner skin 16 formed in a laminated construction as is conventional in the art. The radome 10 covers and protects the radar set contained therein and situated in cavity 18. As shown in FIGS. 1 and 2, the radome 10 comprises the "nose" portion of the aircraft. While this is the conventional radome location for commercial aircraft, it should be understood that the scope of the invention is not limited to aircraft nose radomes. The invention is equally well suited for use in other radome applications, for example, radomes located in the rear or tail of an aircraft, radomes located under the fuselage, or radomes that are ground-based. For convenience only, the remainder of the discussion is directed to the aircraft nose radome although it should be understood that the principles of the invention are useful for any type of radome.

Figure 3:
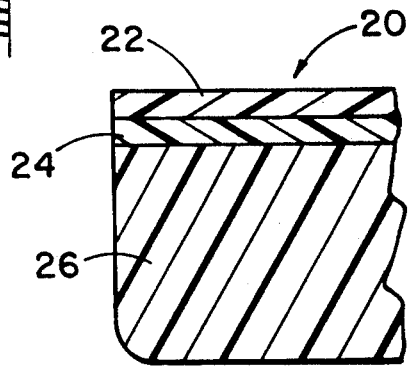
FIG. 3 is a cross-sectional view of a radome constructed and arranged in accordance with a second embodiment of the present invention.

FIG. 3 represents a cross-sectional view of a second embodiment of the invention in which radome 20 covers and protects a radar set contained within cavity 26. However, the second embodiment of the invention eliminates the inner skin layer 16 and includes only an outer skin 22 and a foam core 24. As noted above, in the preferred embodiment of the invention the foam cores 14 and 24 are constructed with Divinycell TM foam.

The vinyl rigid or semi-rigid foam provides a core 14 and 24 having a relatively low static strength/stiffness-to-weight ratio. Thus, prior to the present invention, such vinyl foam could not have been expected to be a suitable material for a radome. Surprisingly, however, it has been found that this structural limitation is counterbalanced by several distinct advantages of the vinyl foam core material. The Divinycell product is a closed-cell foam with unexpectedly superior moisture resistance, it has excellent impact strength characteristics, and it possesses excellent radar transparency characteristics. Good radar transparency insures high signal transmissivity. The moisture resistant closed-cell structure insures that the radome 10 does not retain moisture, even if damaged. As indicated by Table 1 described in more detail below, through extensive testing it has been found that a Divinycell core is over 100 times more resistant to moisture than prior art honeycomb or flex core. Consequently, the moisture intrusion problem associated with the prior art is greatly reduced, thereby producing more consistent radar performance in service since no ice or water in the electrical window will distort transmission. Moreover, a Divinycell foam core radome provides a more reliable weather radar system. Furthermore, the transmissivity cannot be affected by resin pooling in the core during fabrication or repair. The core's excellent moisture resistance and impact strength lead to long expected service life.

Vinyl rigid or semi-rigid foam core radomes, such as Divinycell core radomes made according to the teachings of the present invention, have a greater resistance to both single and multiple impacts when compared to the commonly used honeycomb structure. As a result, the higher impact strength means moisture paths are much less likely to be created and thus the structural integrity of the radome will remain intact.

It is known that sandwich stiffness is an important design criteria for nose radomes. This is attributable to the sandwich construction providing improved strength characteristics, without the addition of much weight. Since radomes generally have large length-to-thickness ratios, the skin and sandwich thickness are far more important than core properties in determining sandwich and radome stiffness. To provide the desired structural integrity, the foam core 10 has a density in the range of about 65–160 kg/m$^3$. Preferably, the foam core 10 has a density of approximately 90 kg/m$^3$, which is structurally sufficient. Prior art radomes such as the 737-style radomes by comparison, are generally constructed with 64 kg/m$^3$ density fiberglass honeycomb and 80 kg/m$^3$ density nomex flex core in the nose.

While honeycomb and flex core possess sufficient static properties such as density and strength and modulus, vinyl rigid or semi-rigid foam cores, such as Divinycell, have superior environmental properties, including water absorption and shear strain, i.e. impact strength.

In the preferred embodiment, each of the outer and inner skin layers of the radome are formed of fiber reinforced plastic or so-called "prepreg." As is well known in the art, "prepreg" refers to dry synthetic woven fiber that has been impregnated with a resin (having a curing agent therein) and then stored at cool temperatures. When the prepreg is ready for use, it is subjected to heat to allow curing of the product. Each skin layer includes one or more plies or layers as is also well-known in the art. The thickness of the outer or inner skin layer is thus dependent on the number of plies used to form the skin layer. In the preferred embodiment, each of the inner and outer layers is a 4-ply skin.

To manufacture the radome, the outer skin is placed on an inner surface of a female layup mold. The foam core is preformed and is then inserted onto the outer skin, which is sticky. A bagging film (formed of high temperature-resistant plastic) is then placed onto the foam core. The mold is then cured while a vacuum removes air from between the bagging film and the outer skin, thus laminating the foam core to the outer skin. After the curing step, the bag is removed and the inner skin is placed onto the foam core. The above steps are then repeated to create the final product. A one-stage process may also be used (such that the layers 12, 14 and 16 are laminated at one time) if significantly high enough temperatures and pressures can be achieved (e.g., through use of an autoclave).

EXPERIMENTAL DATA

A number of tests, including water absorption, radar transmissivity, impact, damage propagation and rain erosion, have been performed to verify critical radome properties of the present invention.

Water Absorption Test Procedures

Several core materials were informally tested for moisture resistance. Polymethacrylimide (50 kg/m$^3$) foam core and Divinycell foam core (90 kg/m$^3$) were tested per ASTM-D-2842 for ten days. Honeycomb (64 kg/m$^3$) and flex core (80 kg/m$^3$) are open-cell materials, so the cells fill completely upon immersion. Their moisture absorption value is somewhat contrived, but it is a realistic measure of resistance to moisture intrusion in service, i.e. practically none.

TABLE 1

| | | Comparison of Cores | | | | |
|---|---|---|---|---|---|---|
| | DENSITY (kg/m$^3$) | SHEAR STRENGTH (MPa) | SHEAR MODULUS (MPa) | SHEAR STRAIN (%) | ABSORPTION WATER (kg/m$^2$) | DIELECTRIC CONSTANT |
| DIVINYCELL CMN 2000 CLASS 3 | 85–105 | 1.1–1.4 | 26.0–36.3 | 15–23 | <0.05 | 1.12 |
| *HONEYCOMB HRP 3/16 4.0 | 58–69 | L: 1.5–2.4<br>W: 0.9–1.2 | L: 80.6–98.6<br>W: 43.5–53.1 | NOT AVAILABLE | 6.0 | 1.11 |
| *FLEX CORE HRH 5/50-10 5.0 | 72–88 | L: 2.1–2.8<br>W: 1.2–1.6 | L: 68.2–83.4<br>W: 40.3–49.3 | NOT AVAILABLE | 6.0 | 1.14 |
| POLYMETH-ACRYLIMIDE | D1 = 63–77<br>D2 = 45–55 | 1.1–1.4<br>(D1) | 29.1–35.5<br>(D1) | 3–5<br>(D2) | 1.56<br>(D2) | NOT AVAILABLE |

TABLE 1-continued

| | Comparison of Cores | | | | | |
|---|---|---|---|---|---|---|
| | DENSITY ($kg/m^3$) | SHEAR STRENGTH (MPa) | SHEAR MODULUS (MPa) | SHEAR STRAIN (%) | ABSORPTION WATER ($kg/m^2$) | DIELECTRIC CONSTANT |
| POLYURETHANE | 85-105 | 0.6-0.9 | 9.3-11.7 | NOT AVAILABLE | NOT AVAILABLE | 1.12 |

*L — Ribbon Direction
W — Against ribbon direction

Water Absorption Test Results and Discussion

Figure 4:
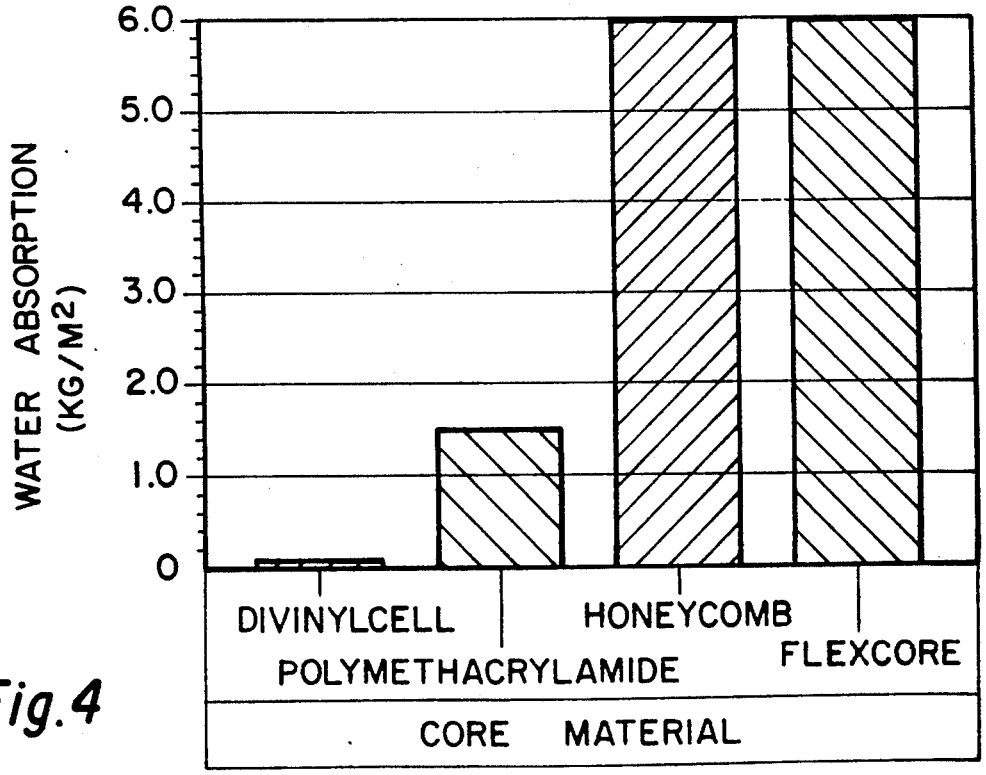
FIG. 4 is a chart of Water Absorption of Various Core Materials.

Table 1 and FIG. 4 summarize the water absorption test results. Divinycell (less than 0.05 $kg/m^2$ absorption) performed at least one order of magnitude better than the other materials. For example, although the densities of the cores were different, the polymethacrylimide foam core (1.56 $kg/m^2$ absorption) was over 35 times more absorbent than the Divinycell core. The honeycomb and flex core absorbed about 6 $kg/m^2$, approximately 100 times more water than Divinycell. Specifically, a 6.35 mm thick piece of bare Divinycell retains only 0.047 kg of water per square meter of surface area, while honeycomb core retains about 6 kg of water, or 15 times its own weight. The difference in structure, namely the water retention of the open-cell honeycomb core as compared with a closed-cell foam, determines moisture resistance in service, and these results indicate that Divinycell core radomes will not experience significant moisture problems in service.

Impact Test Procedures

Impact tests were performed with a Gardner Impact Tester in accordance with ASTM-D-4226. A 1.81 kg cylinder with a 1.59 cm diameter hemispherical steel head was dropped on the panels from various heights. The panels were subjected to single and multiple impacts of various energy to simulate environmental hazards such as hail storms.

Sample Construction

The purpose of this test was to compare the impact strength of Divinycell core sandwich panels with honeycomb core sandwich panels. The panels were made to simulate Boeing 737 radome sandwich construction.

The honeycomb panel construction was:

Outer Skin: 4 plies fiber reinforced plastic fiberglass prepreg

Core: 6.35 mm honeycomb per fiber reinforced plastic

Inner Skin: 4 plies fiber reinforced plastic fiberglass prepreg

The Divinycell panel construction was:

Outer Skin: 4 plies fiber reinforced plastic fiberglass prepreg

Core: 6.35 mm Divinycell core per 90 $kg/m^3$ high temperature grade vinyl foam

Inner Skin: 4 plies fiber reinforced plastic fiberglass prepreg

Impact Test Results and Discussion

Figure 5:
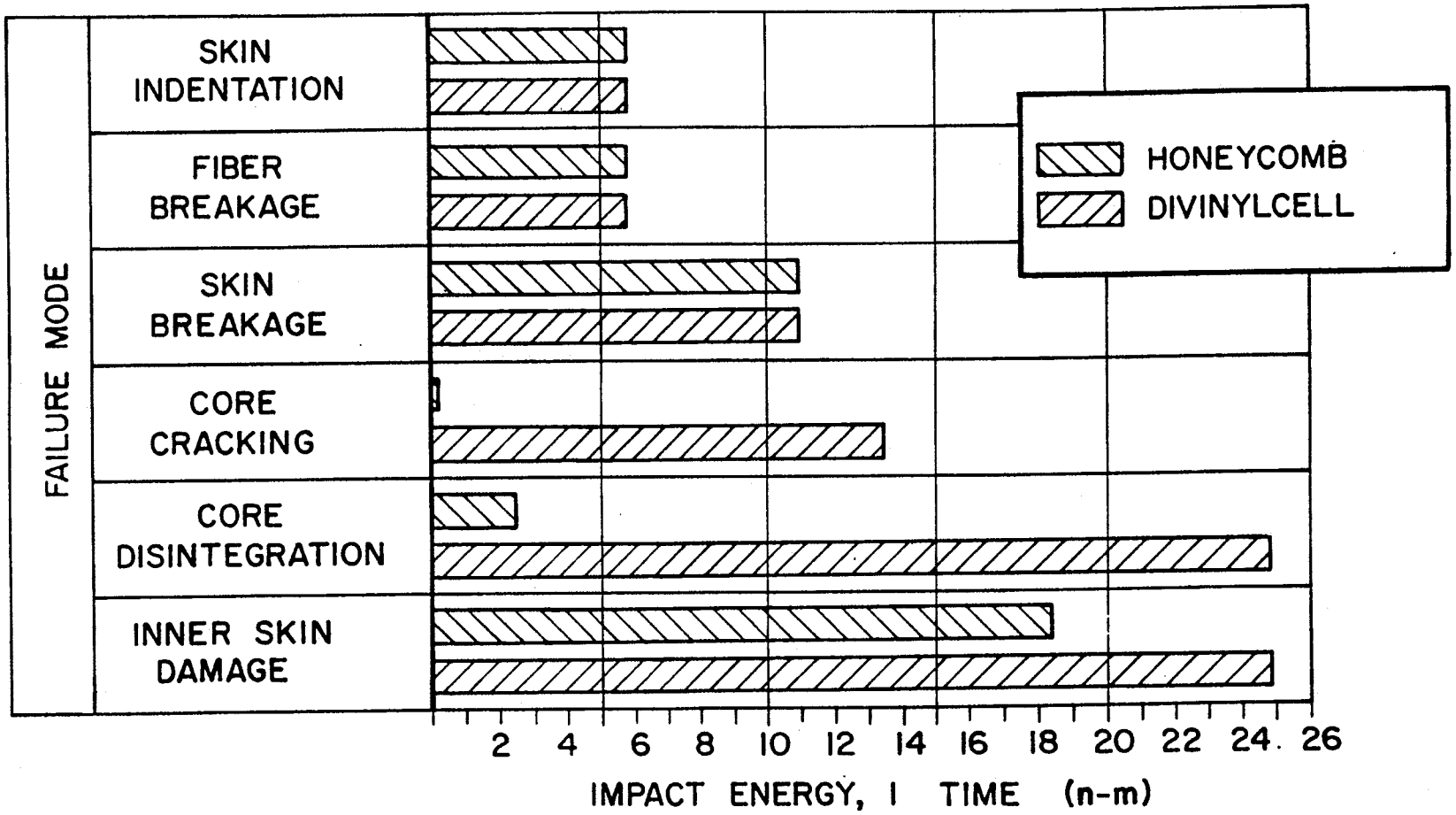
FIGS. 5 and 6 are graphs of Impact Test Results.
Figure 6:
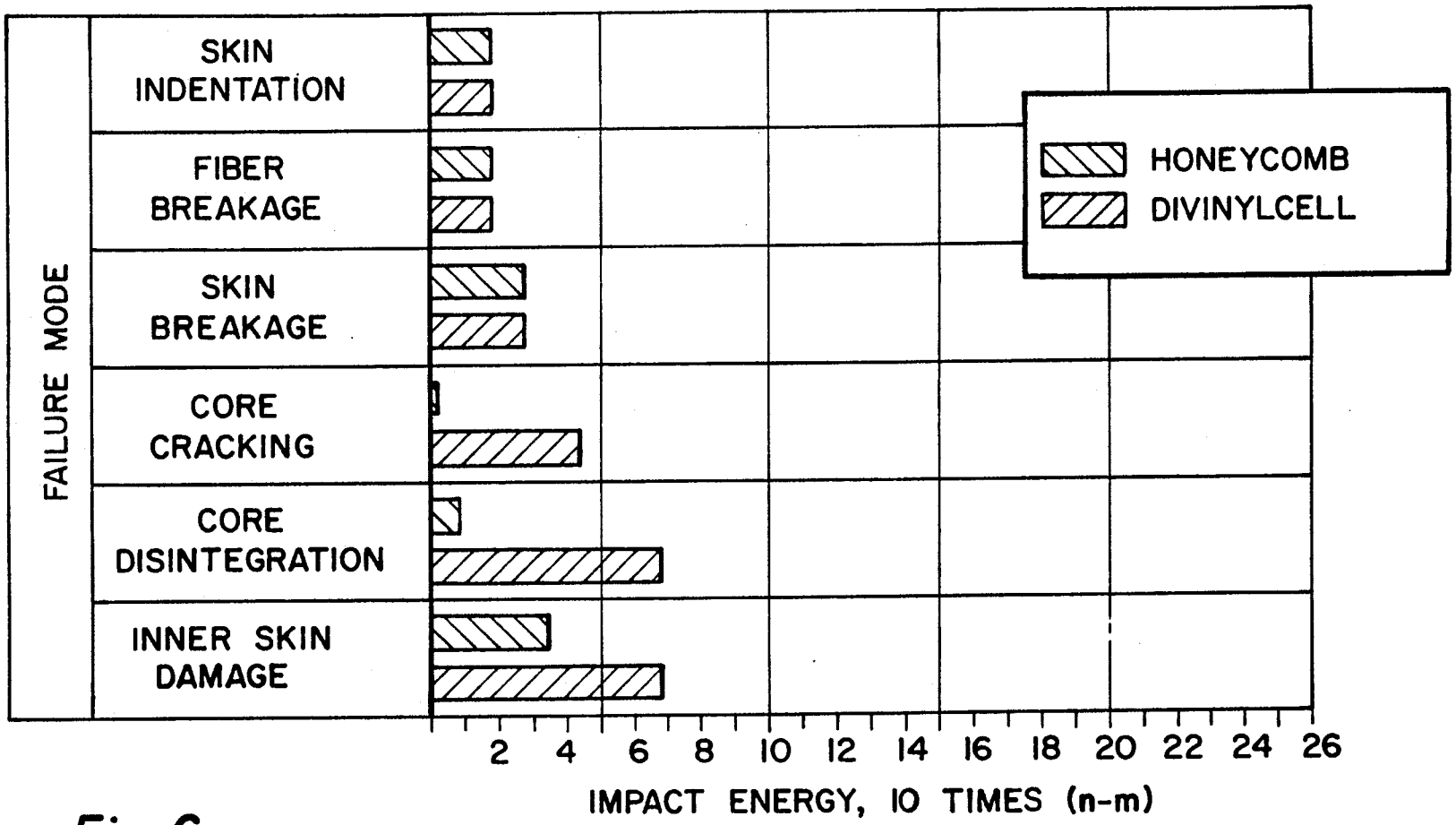

Table 2 below and FIGS. 5 and 6 illustrate the results of the impact tests. The facings failed at the same energy level, which was expected since identical skins were used on both types of panels. The Divinycell foam core impact strength was an order of magnitude higher than the honeycomb core. The honeycomb core failure occurs before facing failure, but the Divinycell core failure did not occur until after facing failure. Thus, the Divinycell panel damage initiation level was an order of magnitude greater than the honeycomb panel level.

Hail impact energy typically ranges from 0 to 1.1 n-m. This is significant because the honeycomb core shattered at multiple low energy impacts. The local facing loses the honeycomb support and becomes vulnerable to microcracking, opening moisture intrusion and propagation paths. In contrast, even at high energy multiple impacts, the Divinycell core never shattered nor separated from the skin. At maximum impact levels, it crushed and cracked in the center. About 45% more energy from a single impact was necessary to penetrate the Divinycell core panels, indicating improved resistance to large bird strikes. The results indicate that a Divinycell radome will be much less susceptible to impact damage than a honeycomb radome. Consequently, increased survivability, extended service life, and reduced maintenance costs are obtained.

TABLE 2

| | Impact Test Results | | | |
|---|---|---|---|---|
| | HONEYCOMB FRP 3/16 4.0 Failure Energy (n-m) | | DIVINYCELL CMN 2000 Class 3 Failure Energy (n-m) | |
| FAILURE MODE | (1×) | (10×) | (1×) | (10×) |
| Skin Indentation (<0.254 mm) | 5.7 | 1.7 | 5.7 | 1.7 |
| Fiber Breakage | 5.7 | 1.7 | 5.7 | 1.7 |
| Skin Breakage | 11.3 | 2.8 | 11.3 | 2.8 |
| Core Cracking | 0.3 | 0.2 | 13.6 | 4.5 |
| Core Disintegration | 2.3 | 0.6 | 24.9 | 6.8 |
| Inner Skin Damage | 18.1 | 3.4 | 24.9 | 6.8 |

Damage Propagation Test Procedure

The purpose of this test was to compare Divinycell and honeycomb sandwich panels for post-impact and post-cycling flexurally strength deterioration and damage propagation. Impact testing was conducted in accordance with ASTM-D-4226, as detailed in the Impact Test Procedures. The impact level was multiple 2.3 n-m impacts. During cycling, the minimum load was zero, and the maximum loan was 700 n. The panels were flexurally cycled 100 times. This cycling simulates flight conditions such as take-offs, landings, and wind loading.

The flexural test procedure was four-point bending with a 15.2 cm span per ASTM-C-393. A sample construction is described in the Impact Test Procedures. The samples were 5.1 cm wide and 0.8 cm thick. The ribbon direction of the honeycomb core was cross-span.

Control Set (undamaged panels) flexural strength was tested. Impact Set panels were impacted ten times with 2.3 n-m of energy per impact. Some samples were cross-sectioned for measurement of damage. Post-impact flexural strength was tested.

Fatigue Set panels were impacted ten times with 2.3 n-m of energy per impact. The panels cycled from 0 to 700 newtons for 100 cycles at a frequency of 5 cycles per minute. Some samples were cross-sectioned for measurement of damage propagation. Post-cycling flexural strength was tested.

Damage Propagation Test Results and Discussion

Table 3 outlines the test results. Both the Divinycell and the honeycomb post-impact flexural strength were equivalent to the Control Set flexural strength, although the average damage diameter of the Divinycell panels (1.6 cm), which is the impact head diameter, was 43% smaller than that of the honeycomb panel damage (2.7 cm).

The Divinycell post-cycling flexural strength also matched the Control Set flexural strength, and no damage propagation was detected. 33% of the honeycomb panels failed within 100 cycles. The surviving honeycomb post-cycling flexural strength was a 5.7% reduction from the post-impact flexural strength. The cycling increased the damage diameter by 13% in the surviving panels, and the others were destroyed.

The results show that a honeycomb core radome that has sustained impact damage can lose flexural strength after being subjected to repetitive short term stresses due to damage propagation. This increases areas of delaminations and moisture propagation.

TABLE 3

Damage Propagation Test Results

| | ULTIMATE FLEXURAL STRENGTH (MPa) | | AVERAGE DAMAGE SIZE (cm) | |
|---|---|---|---|---|
| | HONEY-COMB | DIVINY-CELL | HONEY-COMB | DIVINY-CELL |
| Undamaged panels 4 point, quarter span 15.2 cm flexural | 1.4 | 1.4 | NA | NA |
| Samples impacted 2.3 n-m (10×) | 1.4 | 1.4 | 2.7 | 1.6 |
| *Samples impacted 2.3 n-m (10×), cycled 100× @ 700 newtons (approx. 1.00 MPa) | 1.3 | 1.4 | 3.2 | 1.6 |
| Strength lost after 100 cycles and flexural test | *5.7% | 0% | NA | NA |
| Damage propagation after 100 cycles | NA | NA | 13% | 0% |

*33% of the honeycomb samples failed within 100 cycles. These samples were not included when calculating the ultimate strength

Transmissivity Test Procedure

A completed Boeing 737 Divinycell core radome was tested for X-Bank radar transmissivity. The measuring system consisted of a 9.375 GHz standard gain feed horn, an RCA flat plate circular antenna, and elevation-/aximuth radome positioning unit and instrumentation. The antenna was mounted as it would be on the aircraft. The positioning unit simulates the in-flight antenna sweep by rotating the radome while the antenna remains stationary.

The system was tested without the radome to determine the free-space reference level, or 100% transmission efficiency (transmissivity). After the radome was installed, the new power level was recorded. This power differential is the insertion loss, which is measured in dB, then converted to a percentage. The radome was rotated through various azimuth/elevation sweeps, and the power level was continuously recorded. The insertion loss, which is easily converted to transmissivity, for 91 discreet points in the radome window was recorded.

Transmissivity Test Results and Discussion

Most radome shapes are not hemispherical, so transmissivity variations are expected. Most radome industry standards specify 90% average and 85% individual minimum radar transmissivity, although several manufacturers specifications are considerably less strict. 737 Divinycell radome surpassed these transmissivity requirements with an average of 94.5% and an individual minimum of 89%.

Other radome configurations with a more hemispherical contour and thinner skins, such as the DC9/MD80, will likely produce better transmissivity results. Divinycell's closed-cell structure helps sustain this transmissivity level after repairs, because resin pooling in the cells is substantially reduced.

Rain Impact/Erosion Test Procedure

The purpose of these tests was to evaluate how different core materials effect radome service life. The tests were performed at the Wright-Patterson Air Force Base Rain Impact/Erosion test facility. The following items were constant for all specimens: (1) test conditions; (2) fiberglass/epoxy skin material (0.25 mm per ply); (3) Cure time (90 minutes) and temperature (125° C.); and (4) some type of polyurethane erosion coating. The following items were test variables: (1) core material: fiberglass honeycomb (64 kg/m$^3$) or Divinycell (90 kg/m$^3$); (2) facing ply count: 1, 2, or 3; (3) cure pressure: vacuum (68 kPa) or autoclave (68 kPa); (4) core thickness; 8.9 mm or 6.9 mm; and (5) polyurethane erosion protection: Type A (0.305 mm thick) or Type B (0.457 mm thick).

The construction of the six panels that were tested is as follows:

#1: 3 ply skins, honeycomb core, 8.9 mm thick, erosion protection A, vacuum pressure;

#2: 3 ply skins, honeycomb core, 8.9 mm thick, erosion protection B, vacuum pressure;

#3: 3 ply skins, honeycomb core, 8.9 mm thick, erosion protection B, autoclave pressure;

#4: 4 ply skins, honeycomb core, 6.9 mm thick, erosion protection A, vacuum pressure;

#5: 2 ply skins, Divinycell core, 8.9 mm thick, erosion protection A, vacuum pressure; and

#6: 3 ply skins, Divinycell core, 8.9 mm thick, erosion protection A, vacuum pressure.

Rain Impact/Erosion Test Results and Discussion

Figure 7:
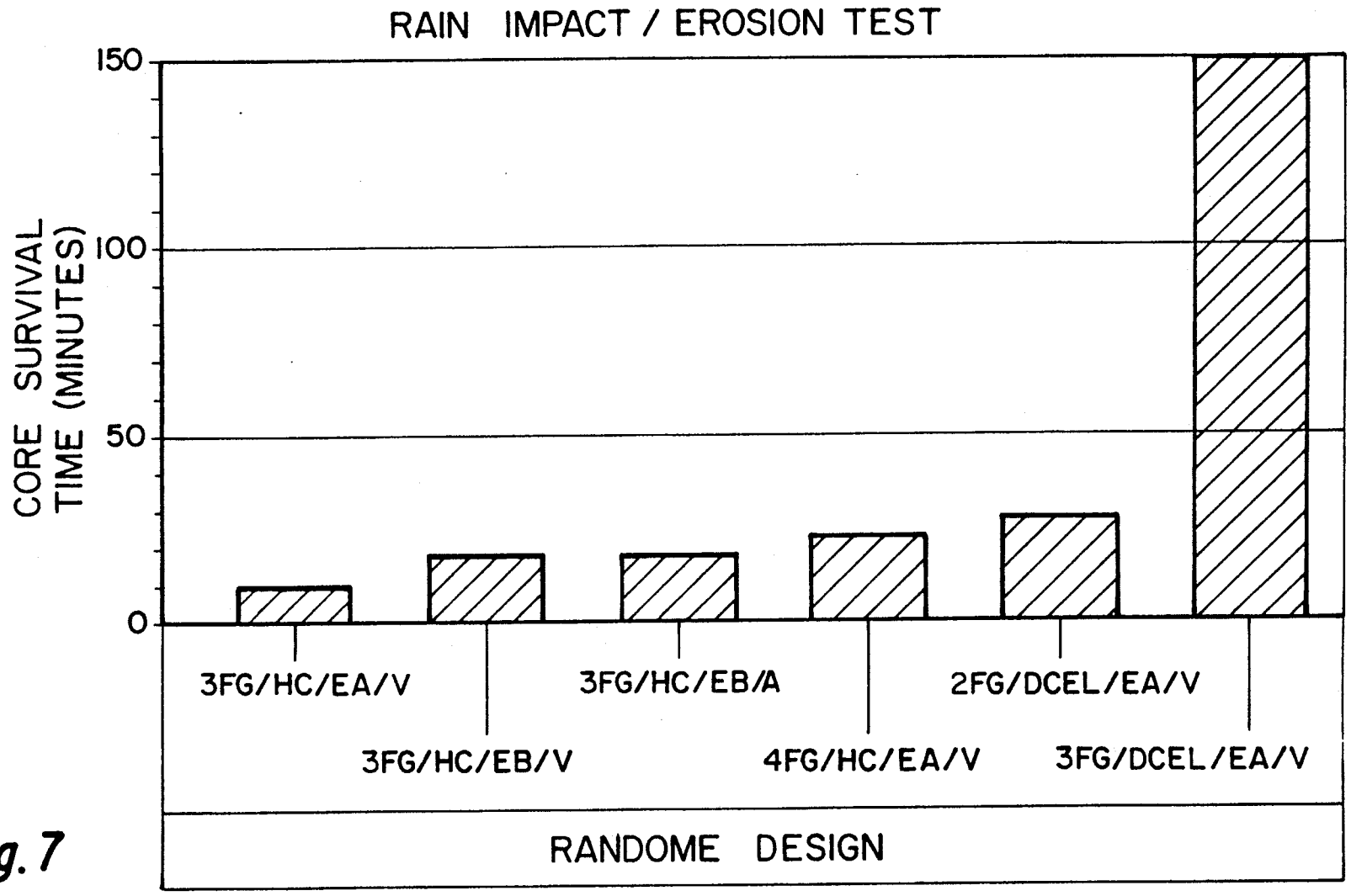
FIG. 7 is a graph of Core Survival Time under a Rain Impact/Erosion Test.

The Rain Impact/Erosion test results displayed in FIG. 7 show that the Divinycell panels survived nearly ten times longer than any of the honeycomb panels. The Divinycell core design with 3-ply skins lasted 150 minutes. The Divinycell panel with 2-ply skins failed in 26 minutes. The honeycomb panels failed between 10 and 20 minutes. Cure pressure or erosion protection type showed no significance in these tests. Core thickness may be a minor factor. The ply count is significant, especially with the Divinycell tests. If the skin is too thin, it will deflect locally, leading to local core deformation and higher core stresses. Local deformation will also promote erosion coating disbonds. If the skin has adequate thickness, the load will be better distributed. Preferably, 3-ply skins on Divinycell core are sufficiently thick for this type of application. The number of skins required is dependent upon the type of radome being utilized, but typically ranges from 1–5 ply-skins. For example, a tail radome may only require a 1-ply skin, while a nose radome typically employs a 4-ply skin.

The core material is clearly a dominant factor in determining rain impact/erosion performance. Assuming adequate skin thickness and erosion protection, the test results indicate core impact failure is the dominant mode of failure. It is also apparent that a Divinycell core radome has greater survivability in high velocity rain.

It should be appreciated by those skilled in the art that the specific embodiments disclosed above may be readily utilized as a basis for modifying or designing other structures for carrying out the same purposes of the present invention. For example, it may also be desirable to use quartz fiber materials instead of the fiberglass material to form the inner and outer skins. In such case, the radome comprises an outer skin comprising a quartz fiber skin layer laminated to a vinyl foam core as previously described. It should also be realized by those skilled in the art that such equivalent constructions do not depart from the spirit and scope of the invention as set forth in the appended claims.

What is claimed:

1. A radome suitable for protecting electromagnetic radar equipment, comprising:

an outer skin having a fiber reinforced plastic ply-skin construction;

a core formed of a rigid, closed-cell foam consisting of a polymeric alloy of a cross-linked aromatic polyamide-urea and a linear vinyl polymer; and an inner skin having a fiber reinforced plastic ply-skin construction, wherein the outer skin, foam core and inner skin are formed in a laminated sandwich construction.

2. The radome as described in claim 1, wherein each of the outer and inner skins is formed of a plurality of fiber reinforced plastic plies.

3. The radome as described in claim 2, wherein each of the outer and inner skins is formed of at least four plies of fiber reinforced plastic cured by the application of heat into a unitary element.

4. The radome as described in claim 1, wherein said foam core has a density in the range of about 65–160 $kg/m^3$.

5. The radome as described in claim 1, wherein said foam core has a density of about 90 $kg/m^3$.

6. The radome as described in claim 1, wherein said foam core is about $\frac{1}{4}''$–$\frac{3}{4}''$ thick.

7. The radome as described in claim 1 for use in an aircraft nose radome.

8. The radome as described in claim 1 for use in an ground-based radome.

9. The radome as described in claim 1 for use in an aircraft tail radome.

10. The radome as described in claim 1, wherein the radome is a fuselage radome.

11. A radome suitable for protecting electromagnetic radar equipment, comprising:

an outer skin formed of at least four plies of fiber reinforced plastic heat fused into a unitary element;

a vinyl rigid closed-cell foam core consisting of a polymeric alloy of a cross-linked aromatic polyamide urea and a linear vinyl polymer, wherein the foam core has a density of about 90 $kg/m^3$; and an inner skin formed of at least four plies of fiber reinforced plastic heat fused into a unitary element, wherein the outer skin, foam core and inner skin are formed in a laminated sandwich construction.

12. The radome described in claim 11 for use in an aircraft nose radome.

* * * * *